US010731581B2

(12) United States Patent
Eser et al.

(10) Patent No.: US 10,731,581 B2
(45) Date of Patent: Aug. 4, 2020

(54) METHOD AND DEVICE FOR OPERATING AN INTERNAL COMBUSTION ENGINE

(71) Applicant: CPT Group GmbH, Hannover (DE)

(72) Inventors: Gerhard Eser, Hemau (DE); Hong Zhang, Tegernheim (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 16/339,958

(22) PCT Filed: Sep. 18, 2017

(86) PCT No.: PCT/EP2017/073511
§ 371 (c)(1),
(2) Date: Apr. 5, 2019

(87) PCT Pub. No.: WO2018/068997
PCT Pub. Date: Apr. 19, 2018

(65) Prior Publication Data

US 2019/0285012 A1 Sep. 19, 2019

(30) Foreign Application Priority Data

Oct. 10, 2016 (DE) ..... 10 2016 219 577

(51) Int. Cl.
*F02M 1/00* (2006.01)
*F02D 41/00* (2006.01)
(Continued)

(52) U.S. Cl.
CPC ..... *F02D 41/0085* (2013.01); *F02D 35/023* (2013.01); *F02D 41/1497* (2013.01);
(Continued)

(58) Field of Classification Search
CPC ..... F02D 35/023; F02D 35/024; F02D 2200/101; F02D 2200/1012
(Continued)

(56) References Cited

U.S. PATENT DOCUMENTS 4,197,767 A * 4/1980 Leung ..... F02D 35/023 123/179.16
7,921,700 B2 4/2011 Raichle et al. ..... 73/114.27
(Continued)

FOREIGN PATENT DOCUMENTS

DE 10 2004 053 347 A1 8/2005 ..... F02D 41/14
DE 10 2006 023 473 B3 5/2007 ..... F02D 41/14
(Continued)

OTHER PUBLICATIONS

German Office Action, Application No. 10 2016 219 577.8, 7 pages, dated Dec. 16, 2016.
(Continued)

*Primary Examiner* — John Kwon
(74) *Attorney, Agent, or Firm* — Slayden Grubert Beard PLLC

(57) ABSTRACT

Various embodiments include method comprising: determining a torque of each cylinder resulting from an injection; determining a difference in the respective torque output; determining a progression of a pressure in one of the cylinders within a cycle; determining a progression of the crankshaft speed within the cycle; determining a time interval between a maximum the pressure and a subsequent maximum of the speed within the cycle; comparing the difference in the torque outputs with a threshold; if the difference exceeds the threshold, determining a progression of the crankshaft speed for each of the cylinders within a respective cycle and determining the respective maxima; determining a respective time of the maxima within the
(Continued)

associated cylinder cycle; determining a difference between the respective maxima; and if the difference is greater than a predetermined threshold, changing an injection time in one of the cylinders based on the determined time interval.

10 Claims, 3 Drawing Sheets

(51) Int. Cl.

| | |
|---|---|
| ***F02D 35/02*** | (2006.01) |
| ***F02D 41/14*** | (2006.01) |
| ***F02D 41/40*** | (2006.01) |
| ***F02D 41/22*** | (2006.01) |
| *F02D 41/38* | (2006.01) |

(52) U.S. Cl.
CPC ..... *F02D 41/1498* (2013.01); *F02D 41/22* (2013.01); *F02D 41/401* (2013.01); *F02D 41/3809* (2013.01); *F02D 2200/024* (2013.01); *F02D 2200/101* (2013.01); *F02D 2200/1002* (2013.01); *F02D 2200/1012* (2013.01)

(58) Field of Classification Search
USPC ..... 123/434, 435, 436, 677, 406.23, 406.41
See application file for complete search history.

(56) References Cited

U.S. PATENT DOCUMENTS

| | | | | |
|---|---|---|---|---|
| 8,088,035 | B2 * | 1/2012 | Yamamoto | B60K 6/365 477/3 |
| 2005/0092300 | A1 | 5/2005 | Asano et al. | 123/436 |
| 2007/0266993 | A1 | 11/2007 | Kettl et al. | 123/406.24 |
| 2008/0133111 | A1 | 6/2008 | Buslepp et al. | 701/103 |
| 2009/0312941 | A1 | 12/2009 | Wang et al. | 701/114 |
| 2010/0036589 | A1 * | 2/2010 | Ando | B60L 15/20 701/105 |
| 2010/0050755 | A1 | 3/2010 | Kappelmann et al. | 73/114.45 |
| 2010/0121555 | A1 | 5/2010 | Fischer et al. | 701/102 |
| 2011/0224888 | A1 | 9/2011 | Girotto et al. | 701/103 |
| 2013/0291830 | A1 * | 11/2013 | Doering | F02N 15/00 123/350 |
| 2020/0011262 | A1 * | 1/2020 | Eser | F02D 41/1497 |
| 2020/0032737 | A1 * | 1/2020 | Eser | F02D 41/1497 |

FOREIGN PATENT DOCUMENTS

| | | | | |
|---|---|---|---|---|
| DE | 10 2006 046 840 | A1 | 4/2008 | F02D 41/22 |
| DE | 10 2008 038 824 | A1 | 8/2009 | F02D 41/00 |
| DE | 10 2008 017 163 | B3 | 11/2009 | F02D 41/00 |
| DE | 10 2009 000 329 | A1 | 4/2010 | F02D 41/00 |
| DE | 10 2010 004 091 | A1 | 7/2011 | F02D 41/00 |
| DE | 11 2009 001 479 | T5 | 9/2011 | F02D 35/00 |
| DE | 10 2010 018 849 | A1 | 11/2011 | F02D 41/00 |
| DE | 10 2010 051 370 | A1 | 5/2012 | F02D 41/00 |
| DE | 10 2013 200 542 | A1 | 7/2014 | F02D 41/00 |
| DE | 10 2013 222 547 | A1 | 5/2015 | F02D 41/30 |
| DE | 10 2014 210 849 | A1 | 12/2015 | F02D 41/00 |
| JP | 2008138681 | A | 6/2008 | |
| WO | 2014/065743 | A1 | 5/2014 | F02D 41/22 |
| WO | 2018/068997 | A1 | 4/2018 | F02D 35/02 |

OTHER PUBLICATIONS

International Search Report and Written Opinion, Application No. PCT/EP2017/073511, 23 pages, dated Jan. 2, 2018.

Korean Office Action, Application No. 20197013238, 5 pages, dated Mar. 30, 2020.

* cited by examiner

METHOD AND DEVICE FOR OPERATING AN INTERNAL COMBUSTION ENGINE

CROSS-REFERENCE TO RELATED APPLICATIONS

This application is a U.S. National Stage Application of International Application No. PCT/EP2017/073511 filed Sep. 18, 2017, which designates the United States of America, and claims priority to DE Application No. 10 2016 219 577.8 filed Oct. 10, 2016, the contents of which are hereby incorporated by reference in their entirety.

TECHNICAL FIELD

The present disclosure relates to internal combustion engines. Various embodiments include methods for operating an internal combustion engine and/or devices for operating an internal combustion engine.

BACKGROUND

In motor vehicles having a so-called common rail injection system (also referred to as accumulator injection system), a plurality of, typically all, injectors are coupled to a common fuel distributor (common rail) which is under a high pressure. The amount of fuel to be injected into the cylinders of the internal combustion engine in each case within a cylinder cycle, also referred to as operating cycle, is typically primarily metered by virtue of the fact that the respective injector is actuated with an actuating period, which is selected to be shorter or longer, in order to inject fuel into the respective cylinder. The injector is in each case opened during the actuating period.

By virtue of manufacturing tolerances and aging phenomena in the injection system, the injection masses can vary between the individual cylinders. This can lead to torque differences between the cylinders, which can have a negative effect on the running smoothness or the emission behavior of the internal combustion engine. Thus, particularly wear phenomena or deposits can lead to a situation in which an actual opening period or an actual degree of opening of the injector for a given fuel pressure and a given actuating period is changed during a service life of the injectors.

SUMMARY

Various embodiments include methods and/or corresponding devices for operating an internal combustion engine that allows reliable operation of the internal combustion engine. For example, various embodiments include a method for operating an internal combustion engine (106) having at least two cylinders (102, 103, 104, 105) for a motor vehicle, comprising the steps: determining a respective torque output of the cylinders (102, 103, 104, 105), which occurs in each case due to an injection of fuel into the respective cylinder (102, 103, 104, 105), determining a difference in the torque outputs, determining a progression of a cylinder pressure (401) in one of the cylinders (102, 103, 104, 105) within a cylinder cycle, determining a progression of a rotational speed (402) of a crankshaft (107) of the internal combustion engine (106) within the cylinder cycle, determining a time interval (403) between a maximum of the progression of the cylinder pressure (401) and a subsequent maximum of the progression of the rotational speed (402) within the cylinder cycle, comparing the difference in the torque outputs with a predetermined threshold value for the torque output, and, if the determined difference exceeds the threshold value, determining a progression of a rotational speed (402) of the crankshaft of the internal combustion engine for all cylinders (102, 103, 104, 105) of the internal combustion engine (106) within a respective cylinder cycle and determining the respective maxima of the progressions, determining a respective time of the maxima within the associated cylinder cycle, determining a difference between the respective times of the maxima, and, if the difference between the respective times is greater than a predetermined threshold value for the time, and changing an injection time at least in one of the cylinders (102, 103, 104, 105) in dependence on the determined time interval (403).

In some embodiments, if the difference between the respective times is less than a predetermined threshold value for the time, changing the injection mass for at least one of the cylinders in dependence on the determined difference in the torque outputs.

In some embodiments, the method further comprises: determining a respective crankshaft acceleration of the crankshaft (107) of the internal combustion engine (106), wherein the crankshaft acceleration occurs in each case due to an injection of fuel into the respective cylinder (102, 103, 104, 105), and determining the respective torque output in dependence on the respective crankshaft acceleration.

In some embodiments, the crankshaft acceleration is determined by means of a transmitter wheel sensor and of a transmitter wheel which is coupled to the crankshaft.

In some embodiments, the crankshaft acceleration is determined in dependence on a running smoothness of the internal combustion engine (106).

In some embodiments, the crankshaft acceleration is determined in dependence on a change in rotational speed of the crankshaft (107).

In some embodiments, the cylinder pressure is determined by means of a cylinder pressure sensor (108) assigned to the cylinder.

In some embodiments, the method further comprises repeating the method steps until a further determined difference in the torque outputs is less than the predetermined threshold value for the torque output.

In some embodiments, the method further comprises determining another defect if, after a predetermined time interval, the further determined difference is not less than the predetermined threshold value for the torque output.

As another example, some embodiments include a device which is designed to carry out a method as described above.

BRIEF DESCRIPTION OF THE DRAWINGS

Further advantages, features, and developments can be gathered from the following examples which are explained in conjunction with the figures, in which.

DETAILED DESCRIPTION

Figure 1:
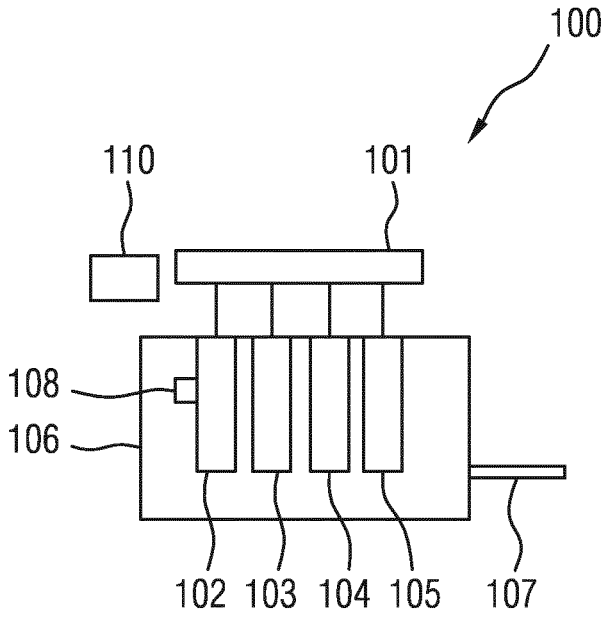
FIG. 1 shows a schematic illustration of a system having an internal combustion engine incorporating teachings of the present disclosure.

In some embodiments, a respective torque output of the cylinders is determined. The torque output occurs due to an injection of fuel into the respective cylinder. A difference in the torque outputs is determined. A progression of a cylinder pressure in one of the cylinders within a cylinder cycle is determined. A progression of a rotational speed of a crankshaft of the internal combustion engine is determined within the cylinder cycle. A time interval between a maximum of the progression of the cylinder pressure and a subsequent maximum of the rotational speed within the cylinder cycle is determined. In particular, the time interval between the respective global maxima within the cylinder cycle is determined. The difference in the torque outputs is compared with a predetermined threshold value for the torque output. If the determined difference exceeds the threshold value, a progression of a rotational speed of the crankshaft of the internal combustion engine is determined for all cylinders of the internal combustion engine within a respective cylinder cycle. The respective maxima of the progressions are determined. A respective time of the maxima within the associated cylinder cycle is determined. A difference between the respective times of the maxima is determined. If the difference between the respective times is greater than a predetermined threshold value for the time, an injection time at least in one of the cylinders is changed. The time is changed in dependence on the determined time interval.

In the case of diesel internal combustion engines, the fuel is injected into the hot, compressed air in the cylinder. The combustion is then initiated by the self-ignition resulting from the cylinder temperature which increases due to the compression. The time between beginning of injection and the beginning of the combustion is termed ignition delay. The chemical ignition delay time greatly depends on the vaporization of the mixture and thus on pressure and temperature. The change in rotational speed then in turn depends on the cylinder pressure and the mass forces.

The injection mass, that is to say the mass of fuel which is in each case injected into the cylinder in order to generate a torque on a crankshaft of the internal combustion engine, is normally in a linear relationship with the torque resulting from the injection mass. The injected amount of fuel therefore normally predetermines the power output of the respective cylinder. The injected amount is thus conventionally proportional to the torque of the crankshaft.

In some embodiments, a method indicates whether different torque outputs of the cylinders occur due to different injection masses, or whether an injection time of the injection is a cause for the different torque outputs. By virtue of the comparison of the cylinder pressure maximum with the maximum of the rotational speed, it is possible to draw a conclusion on the injection time within the cylinder cycle. The injection time is also referred to as injection position or injection phase. In the case of approximately identical combustion conditions in the cylinders, the interval between the cylinder pressure maximum and the maximum of the rotational speed is identical in all cylinders within a predetermined tolerance range. It is thus sufficient to provide a single cylinder pressure sensor on a single one of the cylinders. The other cylinders of the internal combustion engine do not have to be provided with a cylinder pressure sensor.

In the case of a normally operating internal combustion engine, an increase in the fuel mass for the torque-relevant component of the injection leads to an increase in the output torque of this cylinder. A reduction in the injection mass normally results in a corresponding reduction in the torque. However, in the case of an incorrect injection time, it is possible that this effect is not achieved and, for example, an increased injection mass does not lead to an expected increase in the torque. In the method according to the application, if the expected linear relationship between injection mass and torque is not established after a change in the injection mass, the injection time is monitored in each cylinder. This occurs on the basis of the respective maximum of the rotational speed. In the case of a correct injection time in the cylinders, the maximum of the engine rotational speed is in each case within predetermined tolerances at the same time within the cylinder cycle. The cylinder cycle is also termed operating cycle. For example, the time period of the cylinder cycle begins at the top dead center prior to intake and ends at the top dead center after the ejection of the combustion gases.

If the maximum of the rotational speed of the individual cylinders is not at the same time within the respective cylinder cycle, an incorrect injection time can be inferred. Therefore, to adapt the torque outputs, the injection time at least in one of the cylinders is adapted, with the result that the respective times of the maxima within the associated cylinder cycles are identical within the predetermined tolerances. In some embodiments, the method makes it possible to match the torque output of the individual cylinders of the internal combustion engine on the basis of an adaptation of the injection time. By virtue of the additional adaptation of the injection time, it is possible to avoid defective trimming of the cylinder equalization. It can be established whether a deviation in the torque output in fact occurs due to different injection masses or due to an incorrect injection time. The combination of the matching of the torque outputs by adapting the injection masses and of the measuring of the cylinder pressure to determine the injection time allows a beneficial plausibility check between injection deviations and defects in the combustion. Thus, inaccurate error diagnoses can also be avoided.

In some embodiments, if the difference between the respective times is less than a predetermined threshold value for the time, the injection mass for at least one of the cylinders is changed a dependency on the determined difference in the torque outputs. In dependence on the difference between the respective times of the maxima of the rotational speed, either the injection mass is adapted relative to the determined torque deviation or injection time is adapted in dependence on the difference in the times of the rotational speed maxima.

In some embodiments, the respective crankshaft acceleration, for example, is determined by means of a transmitter wheel sensor and of a transmitter wheel which is coupled to the crankshaft. The transmitter wheel is, for example, a toothed wheel, and the transmitter wheel sensor is, for example, a Hall sensor. It is thus possible to evaluate tooth times in order to determine the crankshaft acceleration. In some embodiments, the crankshaft acceleration is determined in dependence on a running smoothness of the internal combustion engine. In some embodiments, the crankshaft acceleration is determined in dependence on a change in rotational speed of the crankshaft.

In some embodiments, the method steps described are at least partially repeated until a further determined difference in the torque outputs is less than the predetermined threshold value for the torque output.

In some embodiments, another defect is determined if, after a predetermined time interval, the further determined difference is not less than the predetermined threshold value for the torque output. If the method according to the application, even after being repeatedly carried out after the predetermined time interval, does not result in the torque outputs being matched, another defect is present as a cause for torque deviation, this defect not occurring due to the injection masses or the injection time. The other defect is, for example, a defect in the exhaust gas recirculation or a defect in the compression.

FIG. 1 shows a system 100 having an internal combustion engine 106 and a fuel distributor 101 (also termed common rail). Fuel from a fuel tank (not shown) is collected under high pressure in the fuel distributor 101 and subsequently injected directly into cylinders 102, 103, 104 and 105 of the internal combustion engine 106. The combustion of the injected fuel leads to a torque output of the cylinders 102 to 105 to a crankshaft 107 of the internal combustion engine 106. In the illustrated exemplary embodiment, the internal combustion engine 106 has four cylinders 102 to 105.

In some embodiments, the internal combustion engine has more than four or fewer than four cylinders. The cylinders 102 to 105 can also be referred to as combustion chambers of the internal combustion engine 106.

On account of manufacturing tolerances in the system 100 and through the occurrence of aging phenomena, the actually injected fuel masses can vary between the individual cylinders 102 to 105. For example, the amount of fuel which is actually injected per injector with the actuating period remaining the same varies. These differences between the injection masses of the respective cylinders 102 to 105 lead to different torque outputs of the cylinders 102 to 105 to the crankshaft 107. These torque differences can have a negative effect on the running smoothness or the emission behavior of the internal combustion engine.

A cylinder pressure sensor 108 is mounted on at least one of the cylinders 102 to 105. In the exemplary embodiment illustrated, the cylinder pressure sensor 108 is mounted only on the cylinder 102. No cylinder pressure sensor is mounted on the other cylinders 103 to 105. The cylinder pressure sensor makes it possible to determine the cylinder pressure in the cylinder 102. A device 110, which is, for example, part of an engine controller, is configured to carry out a method explained below in conjunction with FIG. 2 in order to correct the different torque outputs, with the result that the respective torque outputs of the cylinders 102 to 105 lie within a predetermined tolerance range.

Figure 2:
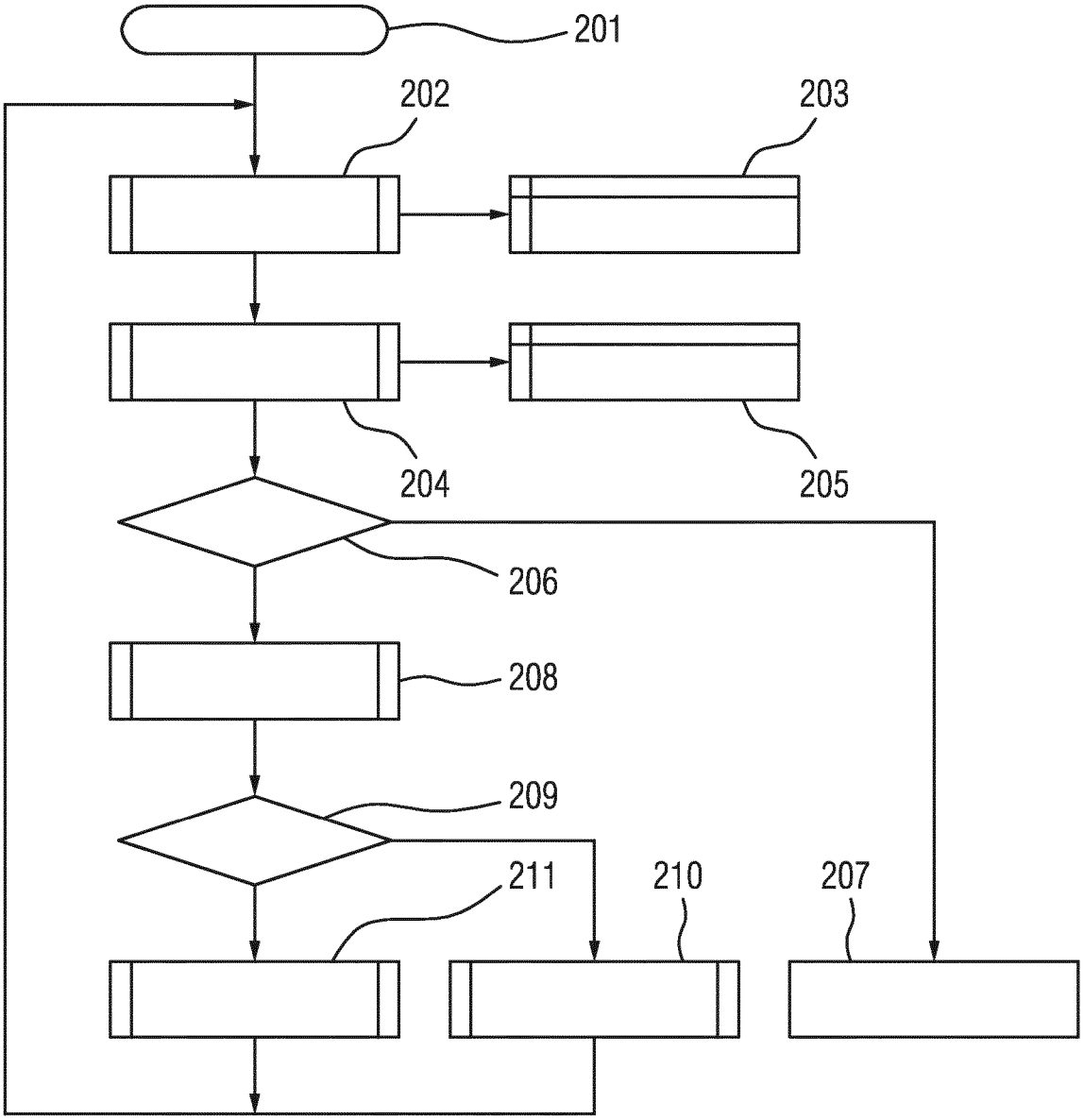
FIG. 2 shows a schematic illustration of a flow diagram of a method incorporating teachings of the present disclosure.

The method according to FIG. 2 is started in step 201. Subsequently, in step 202, the torque output of the cylinder 102 is compared with the torque output of the cylinder 103 and with the torque output of the cylinder 104 and with the torque output of the cylinder 105. For this purpose, for example, the crankshaft acceleration per cylinder cycle of the cylinders 102 to 105 is compared. In some embodiments, a difference in the crankshaft accelerations is determined in order to draw a conclusion on the variations in the crankshaft acceleration. In some embodiments, other combinations of the cylinders 102 to 105 are used for the comparison.

The determined torque difference is stored in step 203 for later use. In step 204, a progression of a cylinder pressure 401 within the cylinder 102 is determined per cylinder cycle. The maximum of the progression is determined. Also determined is a progression of an engine rotational speed within the cylinder cycle of the cylinder 102. The maximum of the rotational speed progression is determined. An interval 403 between the cylinder pressure maximum and the rotational speed maximum is determined.

Figure 4:
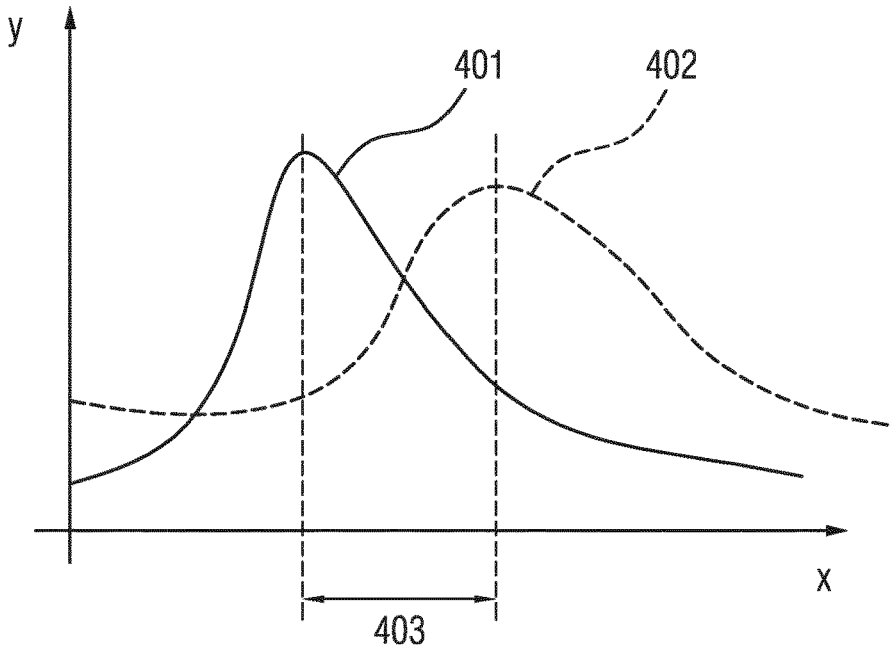
FIG. 4 shows a schematic illustration of the progressions of cylinder pressure and rotational speed incorporating teachings of the present disclosure.

By virtue of the comparison of cylinder pressure maximum with the maximum of the engine rotational speed, a conclusion can be drawn on the injection time, as is evident from FIG. 4. In FIG. 4, the time is plotted on the X axis, and the cylinder pressure and the rotational speed are plotted on the Y axis. The highest compression temperature is established shortly before the top dead center. If a combustion is initiated too early by a too early injection, the combustion pressure rises sharply and counteracts the piston movement in the cylinder.

A too late injection time leads to a slight increase in the cylinder pressure and to a somewhat delayed combustion, which, under a low load, can also lead to an incomplete combustion. The desired interval between the maxima is determined by parameters such as high efficiency, low noise and low pollutant emissions. The measurement by the cylinder pressure sensor 108 makes it possible for this desired interval to be determined and set. The other cylinders 103 to 105 are intended to be correspondingly set on the basis of the respective rotational speed maxima.

In the case of approximately identical combustion conditions within the cylinders 102 to 105, this interval is identical in all cylinders 102 to 105, with the result that the single cylinder pressure sensor 108 on the cylinder 102 is sufficient and a cylinder pressure sensor does not necessarily have to be present in all cylinders.

In step 205, the determined time interval 403 between the maximum of the progression of the cylinder pressure and the subsequent maximum of the rotational speed is stored for later use.

It is determined in step 206 whether a deviation in the respective torque outputs of the cylinders 102 to 105 is greater than a predetermined threshold value. For example, a comparison is made as to whether the difference between the torque outputs is greater than the predetermined threshold value. If the difference is less than the predetermined threshold value, a normally operating system is inferred and the method is at least temporarily ended in step 207 without an adjustment of the injection. If it is determined in step 206 that the deviation in the torque outputs is greater than the predetermined threshold value, the rotational speed maximum of all cylinders within the respective cylinder cycles is subsequently determined in step 208.

It is subsequently determined in step 209 whether the respective rotational speed maxima of all cylinders 102 to 105 are situated at the same point within the respective cylinder cycles within predetermined tolerances.

If it is determined in step 209 that the deviation in the times of the maxima of the rotational speed is less than the predetermined threshold value for the deviation in the times, the injection mass at least in one of the cylinders 102 to 105 is subsequently adapted in step 211. For example, the injection mass which is injected into the cylinder 102 per cylinder cycle is changed. The change in the injection mass is dependent on the determined difference between the torque outputs which have been stored in step 203.

Figure 3:
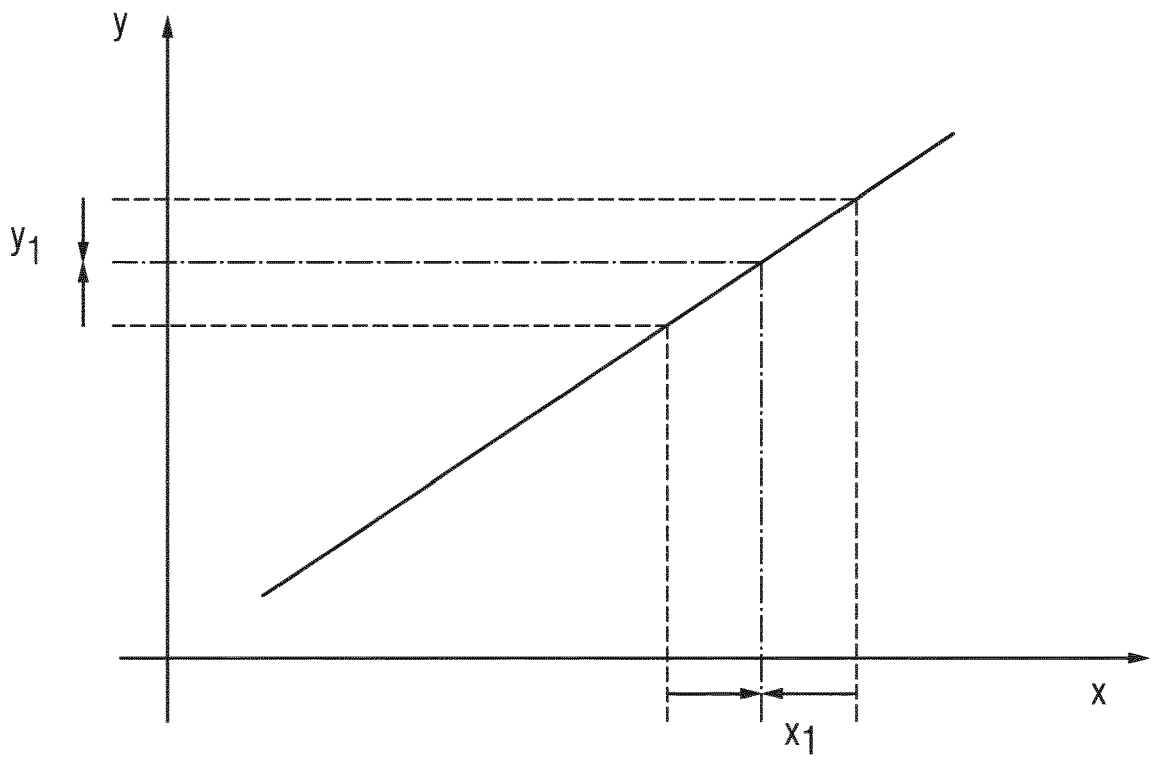
FIG. 3 shows a schematic illustration of the relationship between torque and injection mass incorporating teachings of the present disclosure.

As can be seen particularly from FIG. 3, the injection mass and the torque resulting therefrom are linearly related to one another. The injection mass is plotted on the X axis and the torque on the Y axis. If the torque of the cylinder 102 is intended to be reduced by the value Y1, the injection mass for the cylinder 102 is correspondingly reduced by the value X1. If the torque of the cylinder 102 is intended to be increased, the injection mass for the cylinder 102 is correspondingly increased. If, however, the injection time is incorrect, it is possible that a change in the injection mass does not lead to a corresponding changed torque. For example, an increase in the injection mass does then not lead to an increase in the torque resulting therefrom.

The injection time is particularly the time at which the torque-relevant injection of the injection mass of the fuel occurs per cylinder cycle. The injection time can also be referred to as injection position and/or injection phase. If it is determined in step 209 that the rotational speed maxima do not lie within the predetermined tolerances at the same time within the respective cylinder cycles, the injection time is subsequently changed, in step 210, in dependence on the determined time interval 403 which has been stored in step 205. In particular, the injection time at least of the main injection or of the total torque-relevant injection is adapted. The injection time is changed, for example, such that the interval between the maximum of the cylinder pressure and the maximum of the rotational speed lies within a predetermined time interval.

After step 210 or step 211, the method is started again with step 202 and repeated until the difference in the torque outputs of the cylinders 102 to 105 lies below the predetermined threshold value. The control process is repeated until a uniform torque is displayed on all cylinders 102 to 105 due to the adaptations of the injection mass and of the injection time. In particular, the method steps 202 to 211 are repeated until, in step 206, it is determined that the difference is less than the predetermined threshold value.

If, after a predetermined time period, no convergence of the method occurs, that is to say if it is not established within the predetermined time period that the difference is less than the predetermined threshold value, another defect in the system can be inferred. The different torque outputs are then not caused by different injection masses or an incorrect injection time. Such a defect can be, for example, an inaccuracy in the exhaust gas recirculation or in the compression.

In some embodiments, either the injection mass or the injection time is thus adapted in dependence on the relative times of the rotational speed maxima of the cylinders 102 to 105. It is thus possible to avoid a defective trimming of the cylinder equalization. Since, for example, the injection correction values can also be used by the device 110 for an assessment of the injection, misdiagnoses can be avoided by virtue of the additional plausibility check. Thus, a reliable cylinder equalization in internal combustion engines with direct injection is possible. This leads to a reliable operation of the internal combustion engine 106.

LIST OF REFERENCE SIGNS

100 System
101 Fuel distributor
102-105 Cylinders
106 Internal combustion engine
107 Crankshaft
108 Cylinder pressure sensor
110 Device
201-211 Method steps
401 Cylinder pressure
402 Rotational speed
403 Interval

What is claimed is:

1. A method for operating an internal combustion engine having at least two cylinders, the method comprising:

determining a respective torque output of each of the at least two cylinders resulting from an injection of fuel into the respective cylinder;

determining a difference in the respective torque outputs;

determining a progression of a cylinder pressure in one of the at least two cylinders within a cylinder cycle;

determining a progression of a rotational speed of a crankshaft within the cylinder cycle;

determining a time interval between a maximum of the progression of the cylinder pressure and a subsequent maximum of the progression of the rotational speed within the cylinder cycle;

comparing the difference in the torque outputs with a predetermined threshold value for the torque output;

if the determined difference exceeds the threshold value, determining a progression of a rotational speed of the crankshaft for each of the at least two cylinders within a respective cylinder cycle and determining the respective maxima of the progressions;

determining a respective time of the maxima within the associated cylinder cycle;

determining a difference between the respective times of the maxima; and if the difference between the respective times is greater than a predetermined threshold value for the time, changing an injection time at least in one of the at least two cylinders based at least in part on the determined time interval.

2. The method as claimed in claim 1, further comprising, if the difference between the respective times is less than a predetermined threshold value for the time, changing the injection mass for at least one of the at least two cylinders based at least in part on the determined difference in the torque outputs.

3. The method as claimed in claim 1, further comprising:

determining a respective crankshaft acceleration of the crankshaft in response to an injection of fuel into the respective cylinder; and determining the respective torque output in dependence on the respective crankshaft acceleration.

4. The method as claimed in claim 3, wherein determining the crankshaft acceleration includes monitoring a transmitter wheel sensor and a transmitter wheel coupled to the crankshaft.

5. The method as claimed in claim 3, wherein determining the crankshaft acceleration is based at least in part on a running smoothness of the internal combustion engine.

6. The method as claimed in claim 3, wherein determining the crankshaft acceleration is based at least in part on a change in rotational speed of the crankshaft.

7. The method as claimed in claim 1, in which wherein determining the cylinder pressure includes monitoring a cylinder pressure sensor assigned to the respective cylinder.

8. The method as claimed in claim 1, further comprising repeating the method until a further determined difference in the torque outputs is less than the predetermined threshold value for the torque output.

9. The method as claimed in claim 8, further comprising determining another defect if, after a predetermined time interval, the further determined difference is not less than the predetermined threshold value for the torque output.

10. A device comprising:

a processor; and a memory storing a set of instructions, the set of instructions, when loaded and executed by the processor, causing the processor to:

determine a respective torque output of each of the at least two cylinders resulting from an injection of fuel into the respective cylinder;

determine a difference in the respective torque outputs;

determine a progression of a cylinder pressure in one of the at least two cylinders within a cylinder cycle;

determine a progression of a rotational speed of a crankshaft within the cylinder cycle;

determine a time interval between a maximum of the progression of the cylinder pressure and a subsequent maximum of the progression of the rotational speed within the cylinder cycle;

compare the difference in the torque outputs with a predetermined threshold value for the torque output;

if the determined difference exceeds the threshold value, determine a progression of a rotational speed of the crankshaft for each of the at least two cylinders within a respective cylinder cycle and determining the respective maxima of the progressions;

determine a respective time of the maxima within the associated cylinder cycle;

determine a difference between the respective times of the maxima; and if the difference between the respective times is greater than a predetermined threshold value for the time, change an injection time at least in one of the at least two cylinders based at least in part on the determined time interval.

* * * * *